US007287595B2

(12) United States Patent
Johansen et al.

(10) Patent No.: US 7,287,595 B2
(45) Date of Patent: Oct. 30, 2007

(54) ELECTRIC-HYDRAULIC POWER UNIT

(75) Inventors: John A. Johansen, Kongsberg (NO); Vidar Sten Halvorsen, Kongsberg (NO); Michael R. Williams, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 11/467,374

(22) Filed: Aug. 25, 2006

(65) Prior Publication Data

US 2006/0283600 A1 Dec. 21, 2006

Related U.S. Application Data

(62) Division of application No. 10/780,998, filed on Feb. 18, 2004, now Pat. No. 7,137,450.

(51) Int. Cl.
*E21B 34/00* (2006.01)

(52) U.S. Cl. ..... 166/321

(58) Field of Classification Search ..... None
See application file for complete search history.

(56) References Cited

U.S. PATENT DOCUMENTS

| | | | | |
|---|---|---|---|---|
| 3,589,838 A | | 6/1971 | Tuzson | 417/339 |
| 4,240,463 A | | 12/1980 | Moore | 137/492.5 |
| 4,821,761 A | * | 4/1989 | Aid et al. | 137/101.21 |
| 4,920,811 A | | 5/1990 | Hopper | 74/2 |
| 5,195,721 A | | 3/1993 | Akkerman | 251/129.13 |
| 5,353,870 A | | 10/1994 | Harris | 166/68 |
| 5,497,672 A | | 3/1996 | Appleford et al. | 74/424.8 |
| 5,519,295 A | | 5/1996 | Jatnieks | 318/453 |
| 5,984,260 A | | 11/1999 | Rawson et al. | 251/71 |
| 6,017,200 A | | 1/2000 | Childs et al. | 417/404 |
| 6,065,355 A | | 5/2000 | Schultz | 73/864 |
| 6,182,753 B1 | | 2/2001 | Schultz | 166/162 |
| 6,202,753 B1 | | 3/2001 | Baugh | 166/364 |
| 6,250,199 B1 | | 6/2001 | Schulte et al. | 91/4 R |
| 6,269,874 B1 | | 8/2001 | Rawson et al. | 166/53 |
| 6,595,487 B2 | | 7/2003 | Johansen et al. | 251/129.04 |
| 6,659,177 B2 | | 12/2003 | Bolze et al. | 166/264 |
| 6,702,025 B2 | | 3/2004 | Meaders | 166/335 |
| 2003/0230190 A1 | | 12/2003 | Douglas | 91/454 |

FOREIGN PATENT DOCUMENTS

| | | |
|---|---|---|
| EP | 0 984 133 A1 | 3/2000 |
| EP | 1 209 294 A2 | 5/2001 |
| EP | 1 241 322 A1 | 9/2002 |
| GB | 2 216 570 A | 10/1989 |
| NO | 309737 B1 | 9/1999 |
| WO | WO 95/08715 | 3/1995 |
| WO | WO 01/12950 A1 | 2/2001 |

* cited by examiner

*Primary Examiner*—Frank Tsay
(74) *Attorney, Agent, or Firm*—Williams, Morgan & Amerson, P.C.

(57) ABSTRACT

The present invention is directed to an electric-hydraulic power unit. In one illustrative embodiment, the power unit comprises a body having a movable pressure barrier positioned therein, the movable pressure barrier defining first and second chambers therein, a configurable flow path in fluid communication with the first and second chambers, and at least one valve for configuring the flow path in a first state wherein fluid may flow within the flow path only in a direction from the first chamber toward the second chamber, and a second state wherein fluid within the flow path may flow in both directions between the first and second chambers.

15 Claims, 12 Drawing Sheets

180
190
182
170
162
160
440
370
320
352
312
340
412
430
350
334
414
400
332
330
354
360
410
314
300
310

180
190
182
170
340
162
160
440
370
320
352
412
350
430
332
334
354
400
330
414
360
410
314
300
310

ELECTRIC-HYDRAULIC POWER UNIT

CROSS-REFERENCE TO RELATED APPLICATION

This is a divisional of application Ser. No. 10/780,998, filed Feb. 18, 2004 now U.S. Pat No. 7,137,450 .

BACKGROUND OF THE INVENTION

1. Field of the Invention

The present invention relates to a hydraulic power unit (HPU). More specifically, the present invention relates to an electrically powered HPU having a hydraulically operated failsafe mechanism. In one illustrative embodiment, the present invention is directed to a subsea HPU.

2. Description of the Related Art

A typical subsea wellhead control system, shown schematically in FIG. 1, includes a subsea tree 40 and tubing hanger 50. A high-pressure hydraulic line 26 runs downhole to a surface-controlled subsea safety valve (SCSSV) actuator 46, which actuates an SCSSV. A subsea control module (SCM) 10 is disposed on or near the tree 40. The SCM includes an electrical controller 12, which communicates with a rig or vessel at the surface 32 via electrical umbilical 30.

Through control line 22, the controller 12 controls a solenoid valve 20, which in turn controls the flow of high-pressure hydraulic fluid from hydraulic umbilical 28 to hydraulic line 26, and thus to SCSSV actuator 46. When controller 12 energizes solenoid valve 20, high-pressure hydraulic fluid from umbilical 28 flows through valve 20 and line 26 to energize SCSSV actuator 46 and open the SCSSV. The required pressure for the high-pressure system depends on a number of factors, and can range from 5000 to 17,500 psi. In order to operate the SCSSV, the hydraulic fluid pressure must be sufficient to overcome the working pressure of the well, plus the hydrostatic head pressure.

When solenoid valve 20 is de-energized, either intentionally or due to a system failure, a spring in valve 20 returns the valve to a standby position, wherein line 26 no longer communicates with umbilical 28, and is instead vented to the sea through vent line 24. The SCSSV actuator is de-energized, and the SCSSV closes. Typically, solenoid valves such as 20 are relatively large, complex, and expensive devices. Each such valve may include ten or more extremely small-bore check valves, which are easily damaged or clogged with debris.

Through control line 23, the controller 12 controls a number of solenoid valves such as 14, which in turn control the flow of low-pressure hydraulic fluid from hydraulic umbilical 16 to hydraulic line 44, and thus to actuator 42. Typically the low-pressure system will operate at around 3000 psi. Actuator 42 may control any of a number of hydraulic functions on the tree or well, including operation of the production flow valves. A typical SCM may include 10 to 20 low-pressure solenoid valves such as 14.

For economic and technical reasons well known in the industry, in subsea wells it is desirable to eliminate the need for hydraulic umbilicals extending from the surface to the well. Referring to FIG. 2, one known method for accomplishing this is to provide a source of pressurized hydraulic fluid locally at the well. Such a system includes an SCM essentially similar to that shown in FIG. 1. However, in the system of FIG. 2, high and low-pressure hydraulic fluid is provided by independent subsea-deployed pumping systems.

A storage reservoir 64 is provided at or near the tree, and is maintained at ambient hydrostatic pressure via vent 66. Low-pressure hydraulic fluid is provided to solenoid valves 14 through line 60 from a low-pressure accumulator 74, which is charged by pump 70 using fluid from storage reservoir 64. Pump 70 is driven by electric motor 72, which may be controlled and powered from the surface or locally by a local controller and batteries. The pressure in line 60 may be monitored by a pressure transducer 76 and fed back to the motor controller. Hydraulic fluid, which is vented from actuators such as 42, is returned to storage reservoir 64 via line 62. High-pressure hydraulic fluid is provided to solenoid valve 20 through line 68 from a high-pressure accumulator 84, which is charged by pump 80 using fluid from storage reservoir 64. Pump 80 is driven by electric motor 82, which may be controlled and powered from the surface or locally by a local controller and batteries. The pressure in line 68 may be monitored by a pressure transducer 86, and the pressure information fed back to the motor controller.

Subsea systems have also been developed which replace all the low-pressure hydraulic actuators 42 with electrically powered actuators, thus eliminating the entire low-pressure hydraulic system. One possible solution for eliminating the high pressure hydraulic system is to omit the SCSSV from the system, thus eliminating the need for high-pressure hydraulic power. However, SCSSV's are required equipment in many locations, and thus cannot be omitted from all systems. Also, because of the harsh downhole environment, it is not practical to replace the hydraulic SCSSV actuators with less robust electric actuators. Although the high-pressure hydraulic system remains necessary in may systems, it would still be desirable to reduce the number and/or complexity of the components which make up the high-pressure system.

The present invention is directed to an apparatus for solving, or at least reducing the effects of, some or all of the aforementioned problems.

SUMMARY OF THE INVENTION

The present invention is directed to an electric-hydraulic power unit. In one illustrative embodiment, the device comprises a body having a movable pressure barrier positioned therein, the movable pressure barrier defining first and second chambers therein, a configurable flow path in fluid communication with the first and second chambers, and at least one valve for configuring the flow path in a first state wherein fluid may flow within the flow path only in a direction from the first chamber toward the second chamber, and a second state wherein fluid within the flow path may flow in both directions between the first and second chambers.

In another illustrative embodiment, the device comprises a body having a movable pressure barrier positioned therein, the movable pressure barrier defining first and second chambers therein, a configurable flow path defined in the movable pressure barrier, the configurable flow path being in fluid communication with the first and second chambers, and at least one valve coupled to the movable pressure barrier for configuring the flow path in a first state wherein fluid may flow within the flow path only in a direction from the first chamber toward the second chamber, and a second state wherein fluid within the flow path may flow in both directions between the first and second chambers.

In yet another illustrative embodiment, the device comprises a body having a movable pressure barrier positioned therein, the movable pressure barrier defining first and second chambers therein, a configurable flow path defined in the movable pressure barrier, the configurable flow path being in fluid communication with the first and second chambers, and at least one check valve coupled to the movable pressure barrier and positioned in the flow path, the check valve adapted to configure the flow path in a first state wherein fluid may flow within the flow path only in a direction from the first chamber toward the second chamber, and a second state wherein fluid within the flow path may flow in both directions between the first and second chambers.

In still another illustrative embodiment, the device comprises a body having a movable pressure barrier positioned therein, the movable pressure barrier defining at least one chamber therein, and an electric motor operatively coupled to the movable pressure barrier, the electric motor adapted to, when energized, create a resistance force to a pressure force created by a pressure existing in the chamber, and, when de-energized, allow the pressure barrier in the chamber to move in response to the pressure force to a position within the body wherein the pressure within the chamber may be released from the chamber.

In a further illustrative embodiment, the device comprises a body having a movable pressure barrier positioned therein, the movable pressure barrier defining at least one chamber therein, and an electric latch adapted to, when energized, prevent the movable pressure barrier from moving within the body in response to a pressure force created by a pressure existing in the chamber, and, when de-energized, allow the movable pressure barrier in the chamber to move in response to the pressure force to a position within the body wherein the pressure within the chamber may be released.

In yet a further illustrative embodiment, the device comprises a body having a movable pressure barrier positioned within the body, the pressure barrier defining at least one chamber within the body, and an electric motor operatively coupled to the movable pressure barrier, the motor adapted to create a desired working outlet pressure for the device by causing movement of the pressure barrier within the body, move the pressure barrier to a first position to thereby allow the working pressure to exist within the chamber and, when the motor is energized, create a resistance force to a pressure force created by the working pressure existing in the chamber, and, when the motor is de-energized, allow the pressure barrier to move in response to the pressure force to a second position where the working pressure within the chamber may be released from the chamber.

In still a further illustrative embodiment, the device comprises a first body, a first movable pressure barrier positioned within the first body, the first movable pressure barrier defining a first chamber and a second chamber within the first body, a second body, a second movable pressure barrier positioned within the second body, the second movable pressure barrier defining a third chamber and a fourth chamber within the second body, wherein the first chamber is in fluid communication with the third chamber and the second chamber is in fluid communication with the fourth chamber, an output shaft coupled to the second movable pressure barrier, and a controllable valve that is adapted to configure a flow path between the first and second chambers.

In another illustrative embodiment, the device comprises a body having a movable pressure barrier positioned therein, the movable pressure barrier defining first and second chambers therein, a configurable flow path in fluid communication with the first and second chambers, and means for configuring the flow path in a first state wherein fluid may flow within the flow path only in a direction from the first chamber toward the second chamber, and a second state wherein fluid within the flow path may flow in both directions between the first and second chambers.

In yet another illustrative embodiment, the device comprises a body having a movable pressure barrier positioned therein, the movable pressure barrier defining at least one chamber therein, and an electrically powered resistance means operatively coupled to the movable pressure barrier, the resistance means adapted to, when energized, create a resistance force to a pressure force created by a pressure existing in the chamber, and, when de-energized, allow the pressure barrier in the chamber to move in response to the pressure force to a position within the body wherein the pressure within the chamber may be released from the chamber.

In still another illustrative embodiment, the device comprises a body and a movable pressure barrier positioned in the body, wherein the movable pressure barrier defines at least one chamber within the body, the device being configurable in at least two operational modes, each of the operational modes being selectable by movement of the pressure barrier through a switching series of positions.

BRIEF DESCRIPTION OF THE DRAWINGS

The invention may be understood by reference to the following description taken in conjunction with the accompanying drawings, in which like reference numerals identify like elements, and in which.

Figure 1:
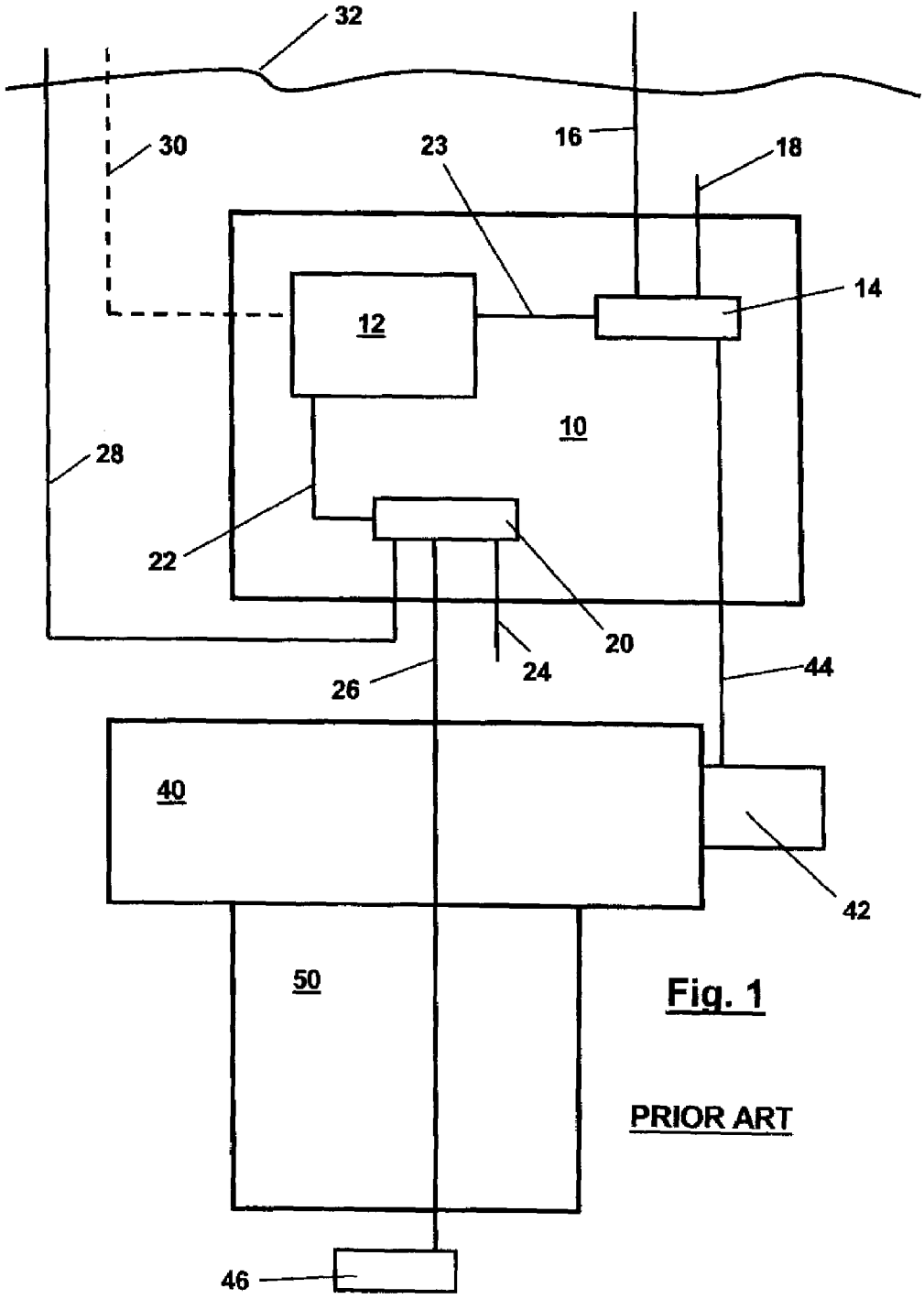
Fig. 1 PRIOR ART
FIG. 1 shows a schematic representation of an existing subsea well completion system utilizing high and low-pressure hydraulic umbilicals to the surface.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention will now be described with reference to the attached figures. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

In the specification, reference may be made to the direction of fluid flow between various components as the devices are depicted in the attached drawings. However, as will be recognized by those skilled in the art after a complete reading of the present application, the device and systems described herein may be positioned in any desired orientation. Thus, the reference to the direction of fluid flow should be understood to represent a relative direction of flow and not an absolute direction of flow. Similarly, the use of terms such as "above," "below," or other like terms to describe a spatial relationship between various components should be understood to describe a relative relationship between the components as the device described herein may be oriented in any desired direction.

Figure 2:
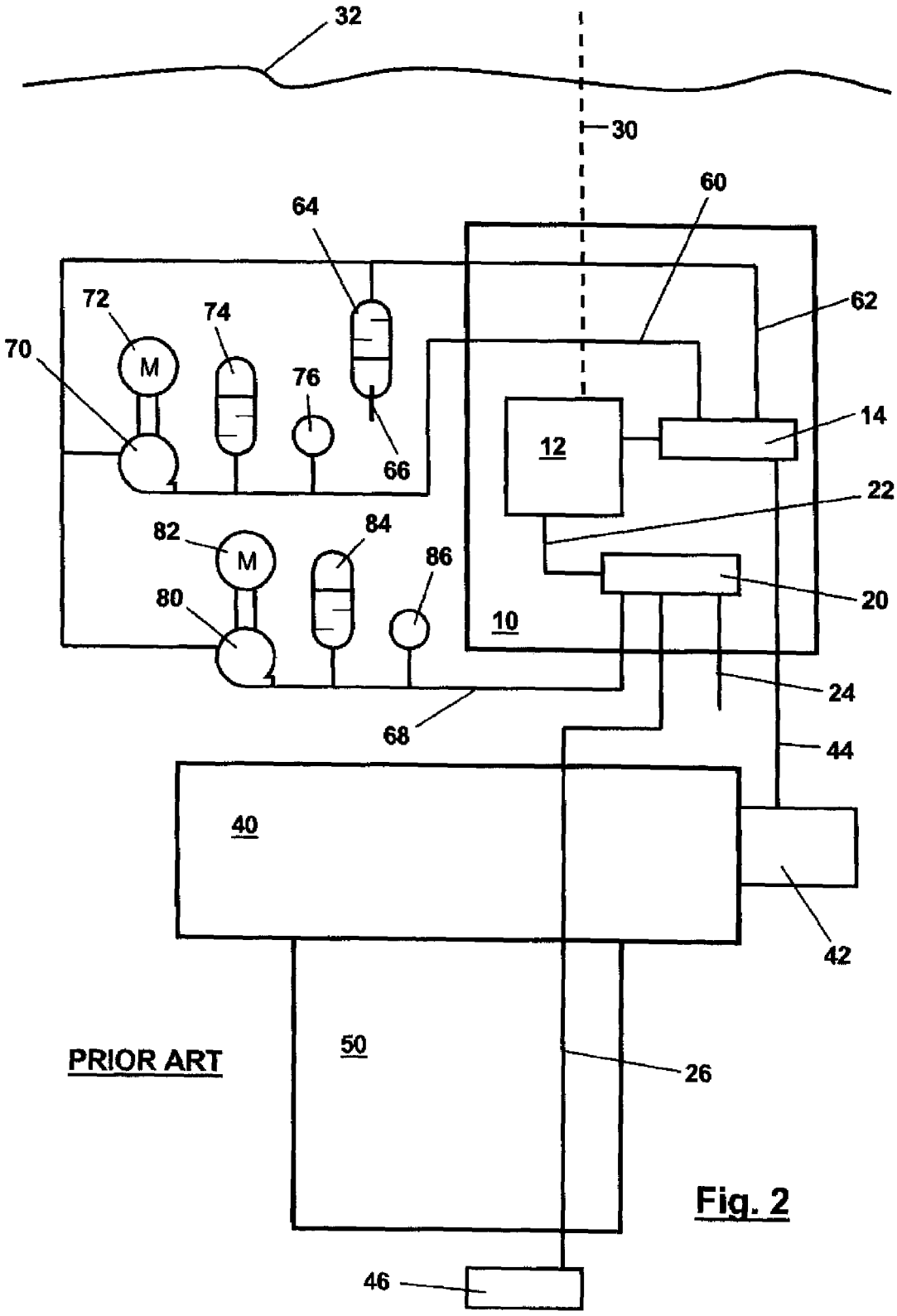
PRIOR ART Fig. 2
FIG. 2 shows a schematic representation of an existing subsea well completion system utilizing a subsea HPU for high and low-pressure hydraulic power.
Figure 3A:
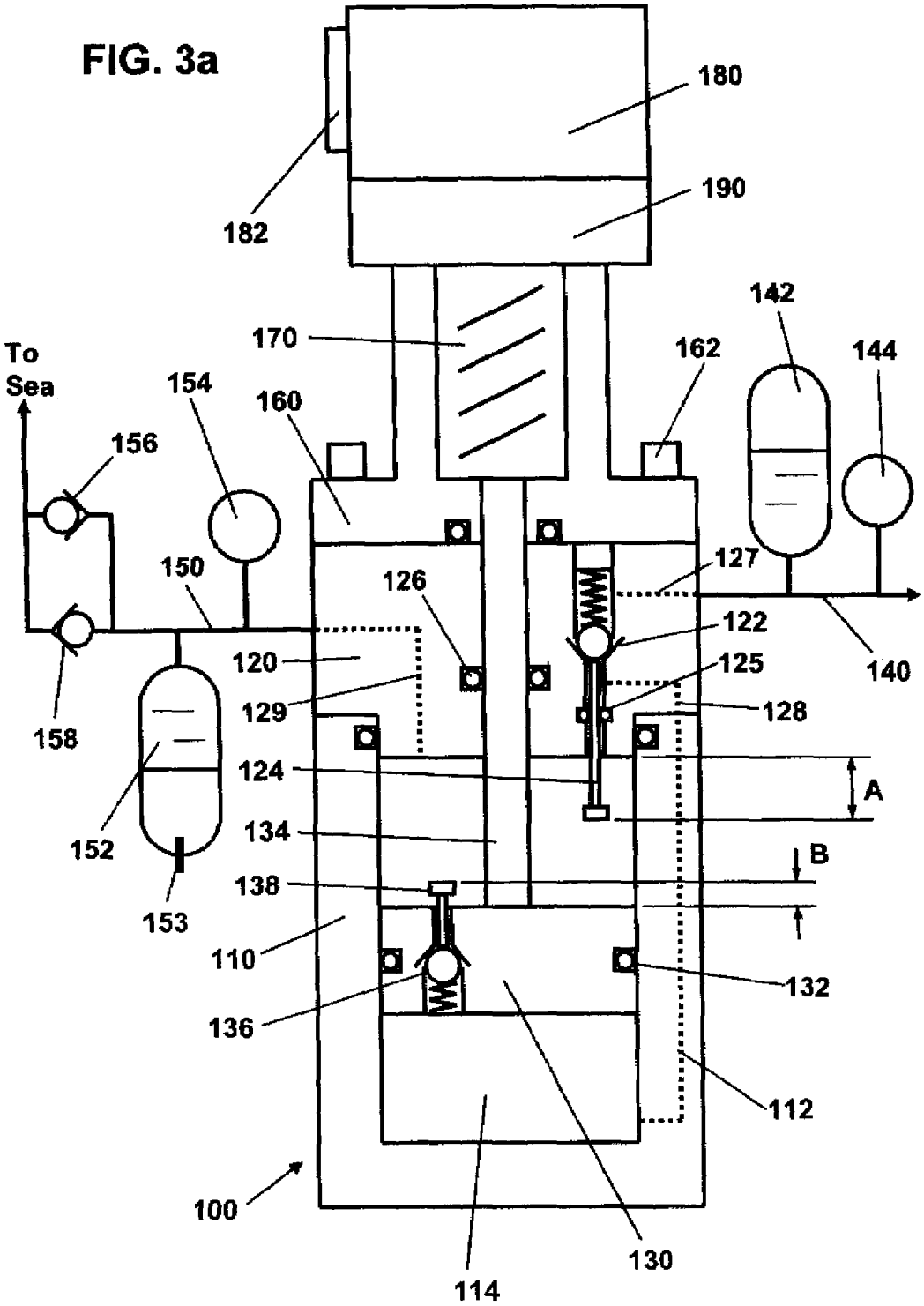
FIG. 3 shows a schematic representation of one exemplary embodiment subsea electric HPU of the present invention.
Figure 3B:
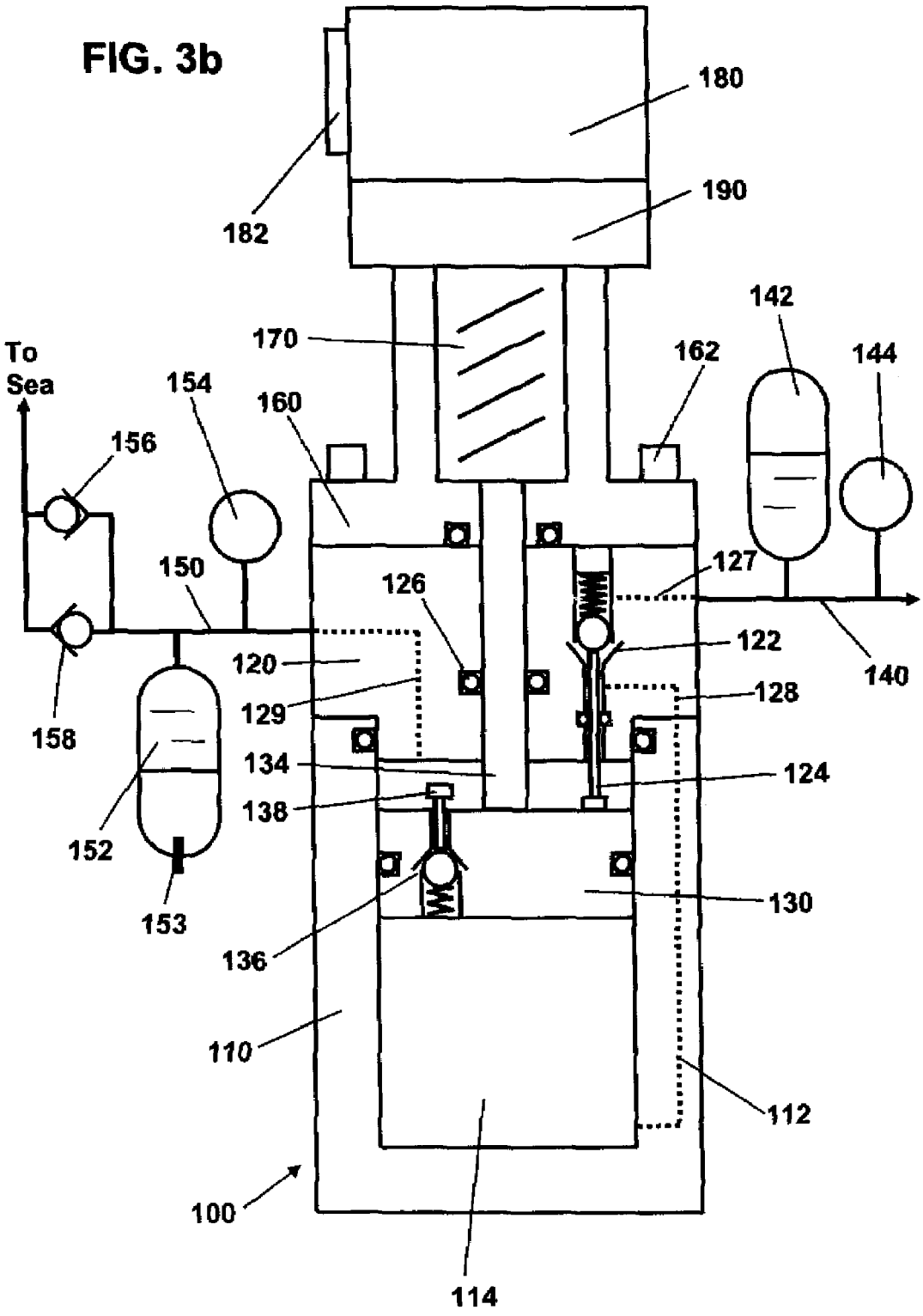
Figure 3C:
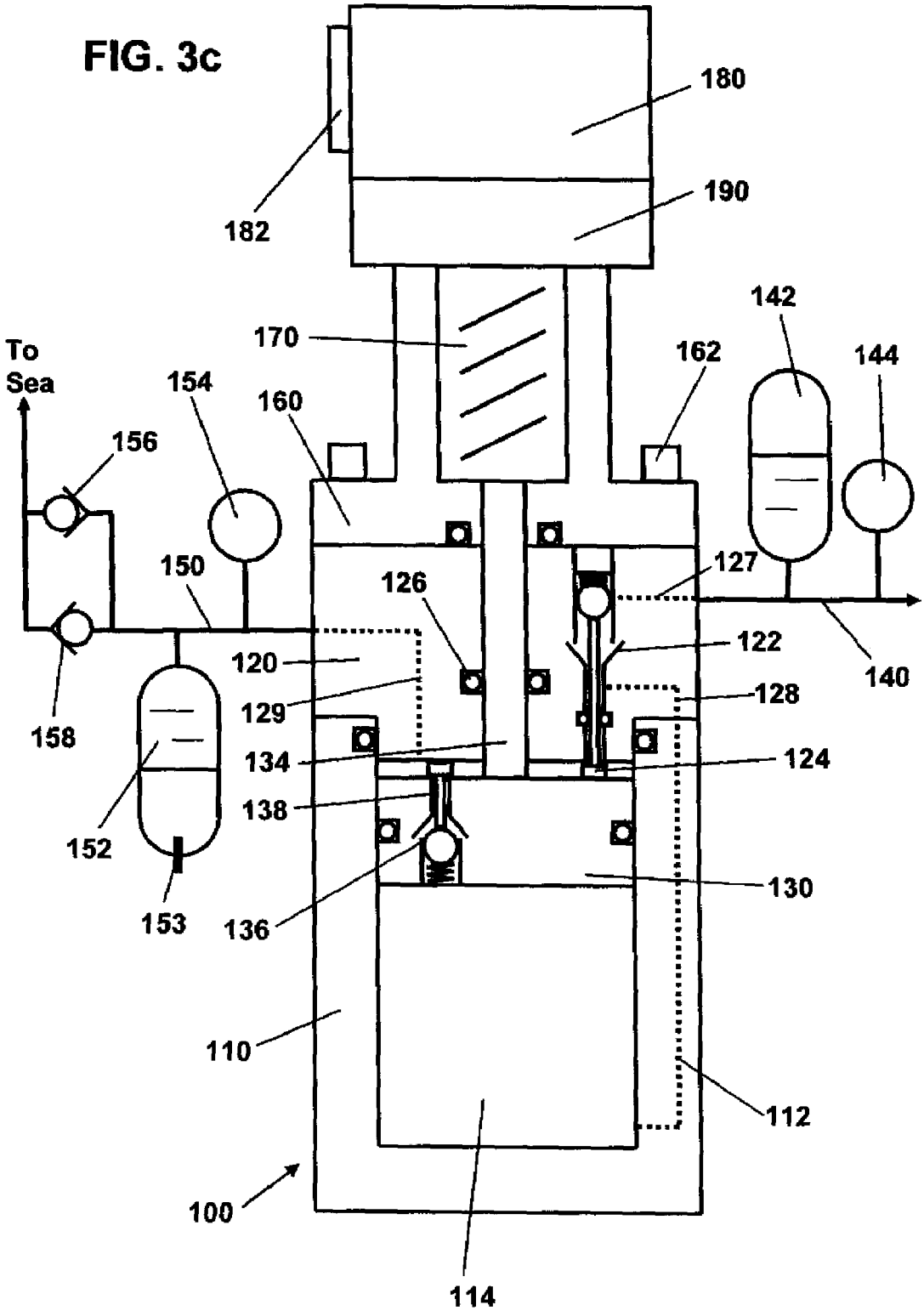

Referring to FIG. 3, in one exemplary embodiment the present invention includes a subsea electric-hydraulic power unit (electric HPU) 100 which replaces the motor 82, pump 80, and the solenoid valve 20 from the system of FIG. 2, and combines them into a single, compact module. In this exemplary embodiment, the source of hydraulic fluid (gas or liquid) is an isolated source of hydraulic fluid that is positioned in an environment, e.g., subsea, that is at a pressure other than atmospheric pressure. In one example, the HPU 100 comprises a housing 110 and cap 120, which cooperate to define a piston chamber 114. Piston 130 is disposed within chamber 114, and is slidably sealed thereto via seal assembly 132. Stem 134 is attached to piston 130, and extends through an opening in cap 120. Stem packing 126 seals between cap 120 and stem 134. In other embodiments, housing 110 and cap 120 could be formed as one integral component, with an opening at the bottom of the housing, which could be sealed by a blind endcap member.

Electric motor 180 may be mounted to cap 120 via mounting flange 160 and bolts 162, or by any other suitable mounting means. The motor 180 may be connected to a motor controller and a power source via connector 182. The motor controller may be deployed subsea and may communicate with a surface rig or vessel via an electrical umbilical or by acoustic signals. Alternatively the motor 180 could be controlled directly from the surface. The motor 180 may be powered by a subsea deployed power source, such as batteries, or the motor 180 could be powered directly from the surface.

In this exemplary embodiment, the motor 180 is connected to stem 134 via planetary gearbox 190 and roller screw assembly 170. Thus, when motor 180 is energized, the rotational motion of the motor is converted into axial motion of the stem 134, thereby also moving piston 130 axially within piston chamber 114. Alternatively, either the gearbox 190 or roller screw assembly 170, or both, could be omitted or replaced by any other suitable transmission devices. In one illustrative embodiment, examples of a suitable motor 180 and gear box 190 combination include a Model Number TPM 050 sold by the German company Wittenstein. Also, alternatively, the motor 180 could comprise a linear motor.

Piston 130 is provided with a one-way check valve 136, which normally allows fluid to flow through the piston from top to bottom only, as viewed in FIG. 3. Piston 130 is also provided with a plunger 138 extending upwardly therefrom, which is arranged to open the check valve 136 to two-way flow when the plunger is depressed. The plunger 138 extends a known distance B above the top of the piston 130, such that when the top of piston 130 is less than distance B from the bottom of cap 120, plunger 138 is depressed and check valve 136 is opened. In alternative embodiments, any suitable flow control device could be used which (a) allows only downward flow through the piston 130 when the piston is more than a distance B from the cap, and (b) allows upward flow when the piston is less than a distance B from the cap.

Cap 120 includes a flow passage 129, which provides fluid communication between hydraulic line 150 and the portion of chamber 114 above the piston. Hydraulic reservoir 152, which is preferably provided on or near the tree, supplies fluid to line 150 and is maintained at ambient hydrostatic pressure via vent 153. Hydraulic line 150 is connected to the sea via oppositely oriented check valves 156 and 158. The pressure in line 150 may be monitored by pressure transducer 154, and the pressure information communicated to the surface and/or fed back to the motor controller.

Under certain circumstances, hydraulic reservoir 152 could become overcharged with fluid, such that the pressure in the reservoir 152 and line 150 becomes too high, and cannot be equalized with the ambient hydrostatic pressure through vent 153. In this case, excess fluid in line 150 would be discharged to the sea through check valve 156, thus maintaining the desired ambient pressure in line 150. Under other circumstances, such as a hydraulic leak, hydraulic reservoir 152 could become depleted of fluid, such that the pressure in the reservoir 152 and line 150 falls below the desired ambient hydrostatic pressure. In this case, seawater may be drawn into line 150 through check valve 158, in order to maintain the desired ambient pressure in line 150. In alternative embodiments, SCSSV actuator 48 and/or downhole hydraulic line 26 could be pre-filled with a fluid which is denser than either the hydraulic fluid used in the rest of the system, or seawater. Thus, if seawater is drawn into the system due to a leak, the heavier fluid will only be replaced by seawater down to the point of the leak. All components below the leak will be exposed only to the heavier pre-loaded fluid.

Cap 120 is provided with a one-way check valve 122, which normally allows flow from bottom to top only, as viewed in FIG. 3. Cap 120 is also provided with a plunger 124 extending downwardly therefrom, which is arranged to open the check valve 122 to two-way flow when the plunger is depressed. The plunger 124 extends a known distance A below the bottom of the cap 120, such that when the top of piston 130 is less than distance A from the bottom of cap 120, plunger 124 is depressed and check valve 122 is opened. Note that distance A is greater than distance B. In alternative embodiments, any suitable flow control device could be used which (a) allows flow in only one direction through the cap 120 when the piston 130 is more than a distance A from the cap, and (b) allows flow in the other direction through the cap when the piston is less than a distance A from the cap.

Flow passage 128 in the cap extends from below the check valve 122 and communicates with passage 112 in the housing 110. Passage 112 communicates with the portion of chamber 114 below the piston 130. Flow passage 127 in the cap extends from above the check valve 122 to hydraulic line 140, which in turn extends to the SCSSV actuator (not shown). As discussed above, in other embodiments the housing 110 and cap 120 could be formed as one integral component. In such an embodiment, all of the features described above with respect to the housing 110 and cap 120 would be incorporated into the combined integral component.

High-pressure hydraulic accumulator 142 is provided on or near the tree, and communicates with line 140. The pressure in line 140 may be monitored by pressure transducer 144, and the pressure information communicated to the surface and/or fed back to the motor controller. In other embodiments, the high-pressure hydraulic accumulator 142 may be omitted.

In one illustrative example, the operation of the HPU 100 is as follows:

Pumping to the Desired Pressure

The present invention may be employed to provide a pressurized fluid to a hydraulically actuable device. In one illustrative embodiment, the device disclosed herein may be employed in connection with subsea wells having a hydraulically actuable SCSSV valve. For purposes of disclosure only, the present invention will now be described with respect to its use to actuate and control the operation of a subsea SCSSV valve. However, after a complete reading of the present application, those skilled in the art will appreciate that the present invention is not so limited and has broad applicability. Thus, the present invention should not be considered as limited to use with subsea wells or controlling SCSSV valves.

When it is desired to open the SCSSV, such as for producing the well, the SCSSV supply line 140 and high-pressure accumulator 142 are charged to the desired pressure by stroking piston 130. Assuming that piston 130 is near the top of chamber, the piston is stroked downward. Check valve 136 prevents hydraulic fluid from flowing upwardly through piston 130. Therefore, hydraulic fluid is forced from chamber 114 through passages 112 and 128, through check valve 122, through passage 127 and into line 140 and accumulator 142. Piston 130 is then stroked upwards. However, piston 130 is not moved all the way to the top of chamber 114. Rather, through precise control of the motor 180, the piston 130 is stopped on the upstroke before contacting plunger 124. Thus, check valve 122 remains closed, and pressure is maintained in accumulator 142 and line 140. As piston 130 rises, a pressure differential develops across the piston, which forces check valve 136 to open. This allows the portion of chamber 114 below the piston to be refilled with fluid from reservoir 152. The piston 130 is then downstroked again, and this process is repeated until the desired working pressure is achieved in accumulator 142 and line 140. This can be considered the pumping mode of operation of the HPU 100.

By precisely controlling the torque and position of motor the 180, the position of piston 130 may also be precisely controlled to maintain the desired pressure in line 140. The SCSSV is now maintained in the open position by the pressure in line 140. Because the desired working pressure can be achieved by repeated stroking of the piston 130, the minimum volume of the piston chamber 114 is independent of the total amount of fluid which actually needs to be pumped. Thus, the total required pumping volume does not constrain the minimum size of the housing 110 and piston 130. Furthermore, in one illustrative embodiment, the HPU 100 does not include any failsafe return spring(s), which are typically quite large and heavy. This allows for further reduction in the size of the unit.

Arming the HPU for Failsafe Shutdown

Once the desired working pressure has been achieved, the HPU 100 is placed in the "armed", or stand-by position. The piston 130 is upstroked until the distance between the piston 130 and the cap 120 is less than distance A, but greater than distance B. In this position, piston 130 contacts and depresses plunger 124, thus opening check valve 122 to two-way flow. However, plunger 138 is not depressed, and thus check valve 136 remains closed to upward flow. Since check valve 122 is opened, the pressure in line 140, i.e., the working pressure, is communicated through check valve 122, passages 128 and 112, and into the portion of chamber 114 below the piston 130. Thus, the pressure from line 140 acts exerts an upward pressure force on the piston 130. In one embodiment, the present invention comprises means for resisting this pressure force. In one example, the means for resisting the pressure force comprises at least the motor 180.

Figure 7:
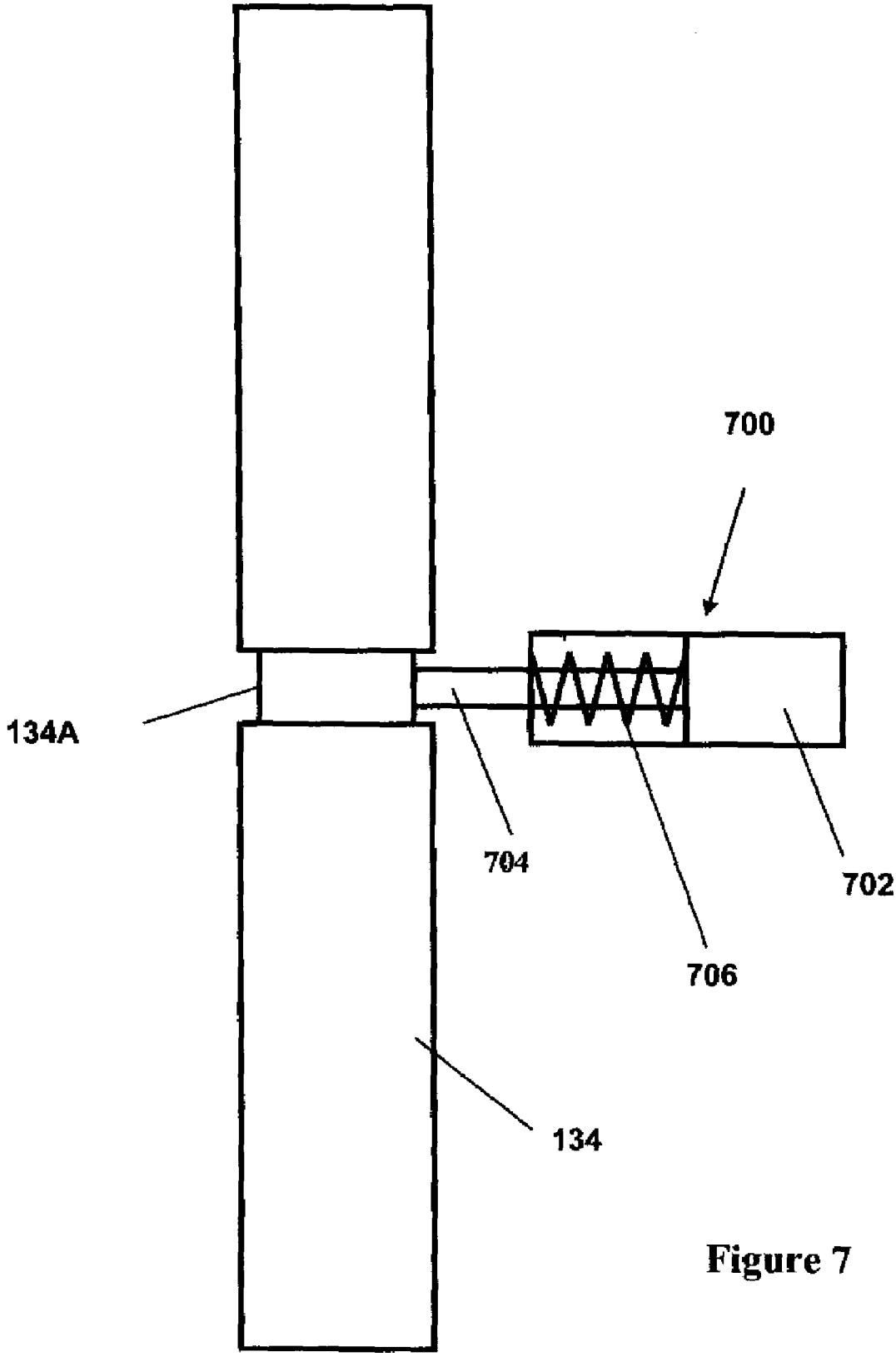
FIG. 7 depicts one illustrative embodiment of a latching mechanism that may be employed with the present invention.

Alternatively, the means for resisting the pressure force may comprise an electric latching mechanism that may be employed to hold the stem and piston in position, thus removing the load from the motor 180. FIG. 7 schematically depicts an illustrative latching mechanism 700 that may be employed with the present invention. As shown therein, the latching mechanism 700 comprises an electrically powered solenoid 702, a pin 704 and a return biasing spring 706. When the latching mechanism is energized, the pin 704 engages a recess or groove 134A formed on the shaft 134. In this embodiment, the latching mechanism 700 would be arranged to release the stem and piston 130 upon a loss of electrical power. This can be considered the armed mode of operation of the HPU 100.

Bleed-Off and Shutdown

When the motor 180 and/or the latching mechanism are de-energized, either intentionally or due to an electrical system failure, the motor and/or latching mechanism will no longer maintain the piston 130 in the armed position. The motor 180, gearbox 190, and roller screw 170 are, in one embodiment, selected and arranged such that the pressure acting on the piston 130 is sufficient to backdrive the motor and transmission assembly and raise the piston to the top of chamber 114. As the piston 130 approaches the top of chamber 114, the cap 120 contacts and depresses plunger 138, thus opening check valve 136 to two-way flow. Thus, the pressure in chamber 114, accumulator 142, and line 140 is exhausted to the ambient pressure reservoir 152 through check valve 136 and passage 129. The SCSSV actuator is now de-energized, and the SCSSV is closed. This may be considered the shut-down mode of operation of the HPU 100.

It should be noted that although the HPU 300 has at least two distinct modes of operation, the desired operational mode is selected by simply moving the piston 130 via precise control of the motor 180. Thus, no additional control signal is required to select the operational mode of the HPU. Because the failsafe mode of the HPU 100 is powered by stored hydraulic pressure, there is no need for a failsafe return spring in piston chamber 114. This results in substantial savings in the weight, size and cost of the unit.

Figure 4:
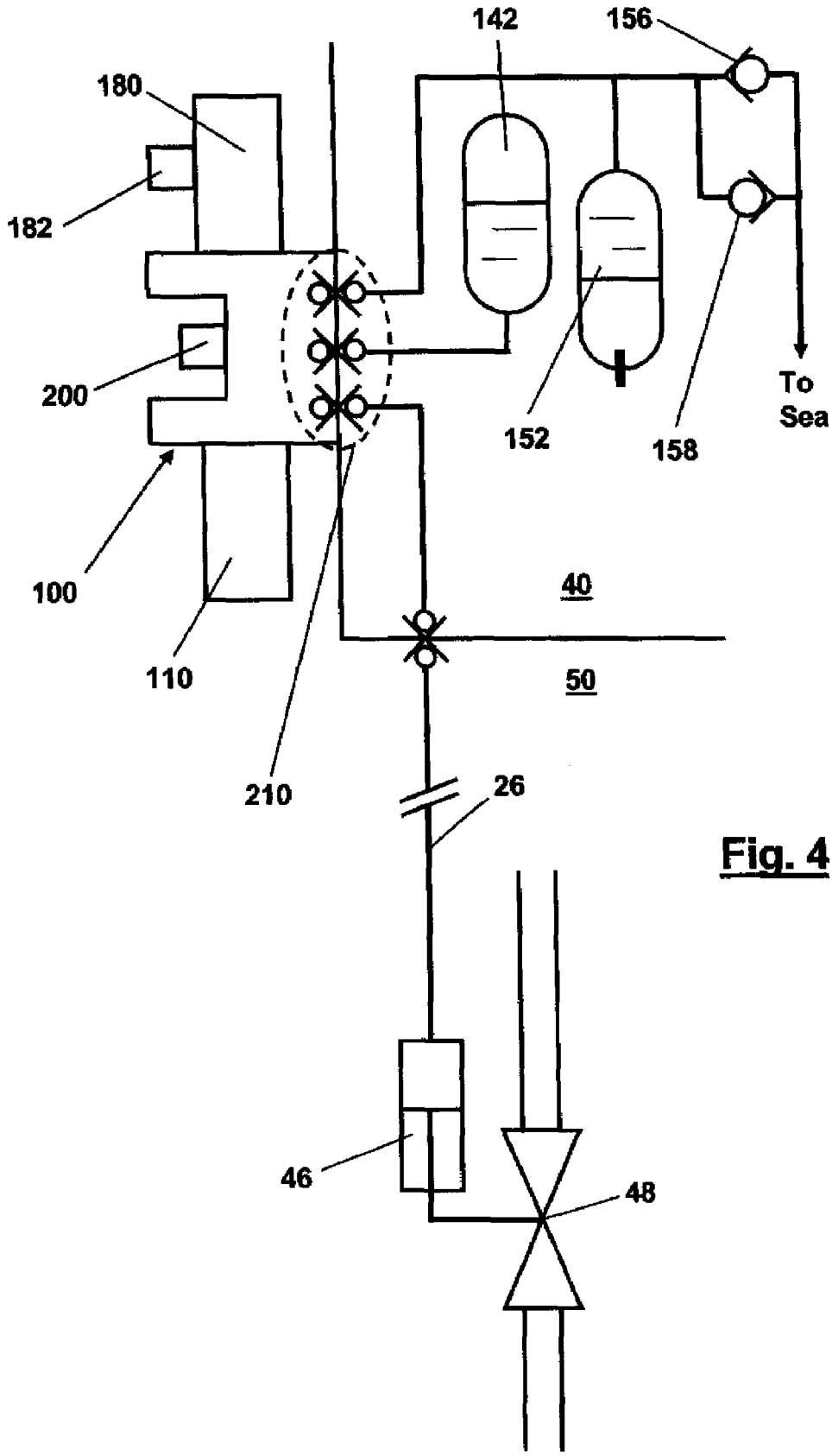
FIG. 4 shows a schematic representation of the subsea electric HPU of FIG. 3 mounted on subsea completion equipment.

Referring to FIG. 4, the exemplary embodiment of the subsea HPU 100 is shown schematically in relation to the other components of the subsea system. The HPU 100 may be attached to the tree 40 via multi-quick connector (MQC) 210. HPU 100 may comprise an electrical system including motor 180, and a hydraulic system including housing 110. Electrical connector 182 may be provided for powering and controlling the motor 180. HPU 100 may also comprise MQC torque tool interface 200. High-pressure hydraulic fluid may be routed from the HPU 100, through tree 40, tubing hanger 50, and hydraulic line 26 to SCSSV actuator 46, which operates SCSSV 48. Ambient-pressure reservoir 152 and high-pressure accumulator 142 may be provided on or near the tree 40. The compact design of the HPU 100 allows the unit to be installed and retrieved by a remotely operated vehicle (ROV).

Figure 5A:
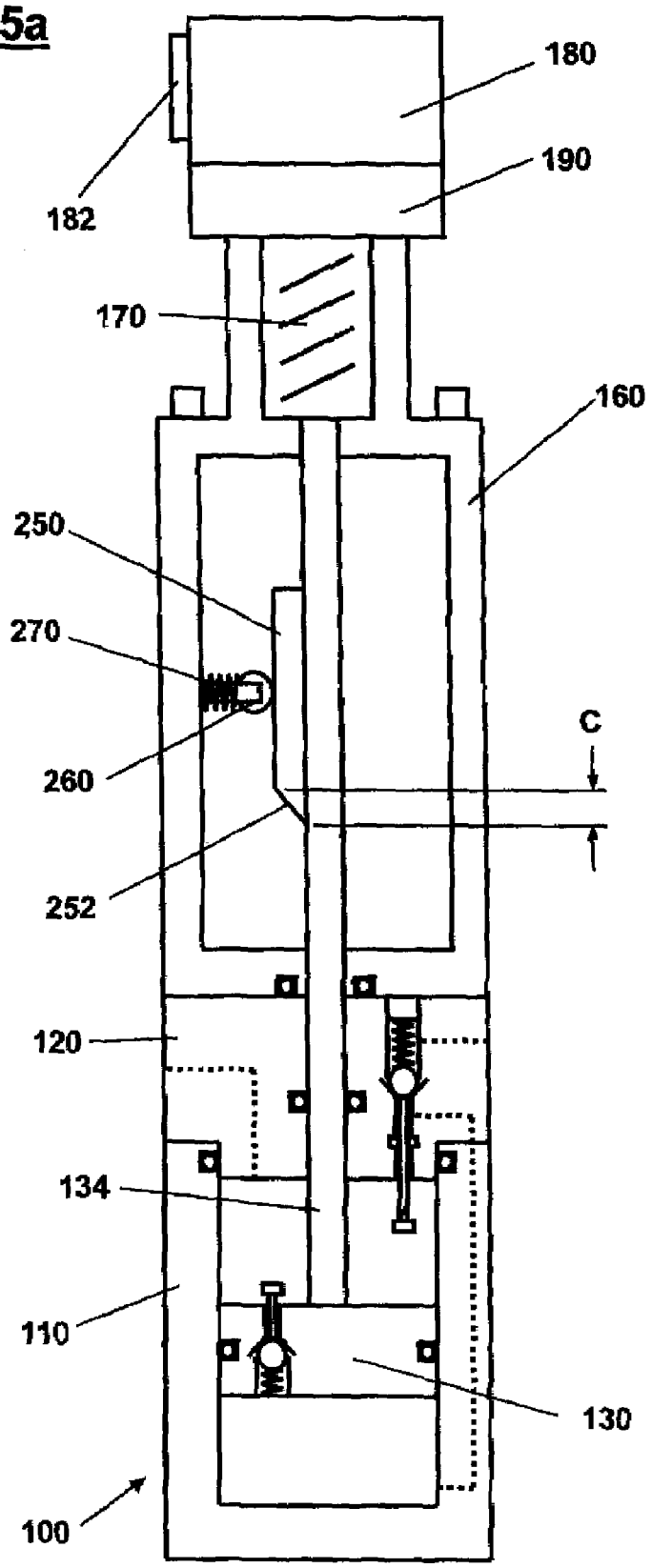
FIGS. 5*a* and 5*b* show schematic representations of an alternative exemplary embodiment subsea electric HPU having a mechanical failsafe assist device.

Referring to FIG. 5*a*, an alternative exemplary embodiment electric HPU is shown which includes a mechanical failsafe assist device. In this embodiment, the motor mounting flange 160 and shaft 134 are extended in length. A cam member 250 is attached to shaft 134 by welding or other suitable means. Cam member 250 includes a lower tapered section 252 having a known axial length C. Length C is at least as great as the difference between distance A and distance B, as shown in FIG. 3. A cam follower 260 is mounted within the flange 160, and is biased towards the cam member 250 by spring 270. During the pumping stroke of piston 130, the cam follower rides on a straight section of cam member 250, and thus does not exert an axial force on shaft 134. In an alternative exemplary embodiment, two or more cam members could be disposed about the diameter of the shaft 134 and engaged by a two or more separate spring loaded cam followers. In a further alternative exemplary embodiment, the cam member could be generally cylindrical in shape, and disposed around the shaft 134. The cylindrical cam member may be engaged by one or more spring-loaded cam followers.

Figure 5B:
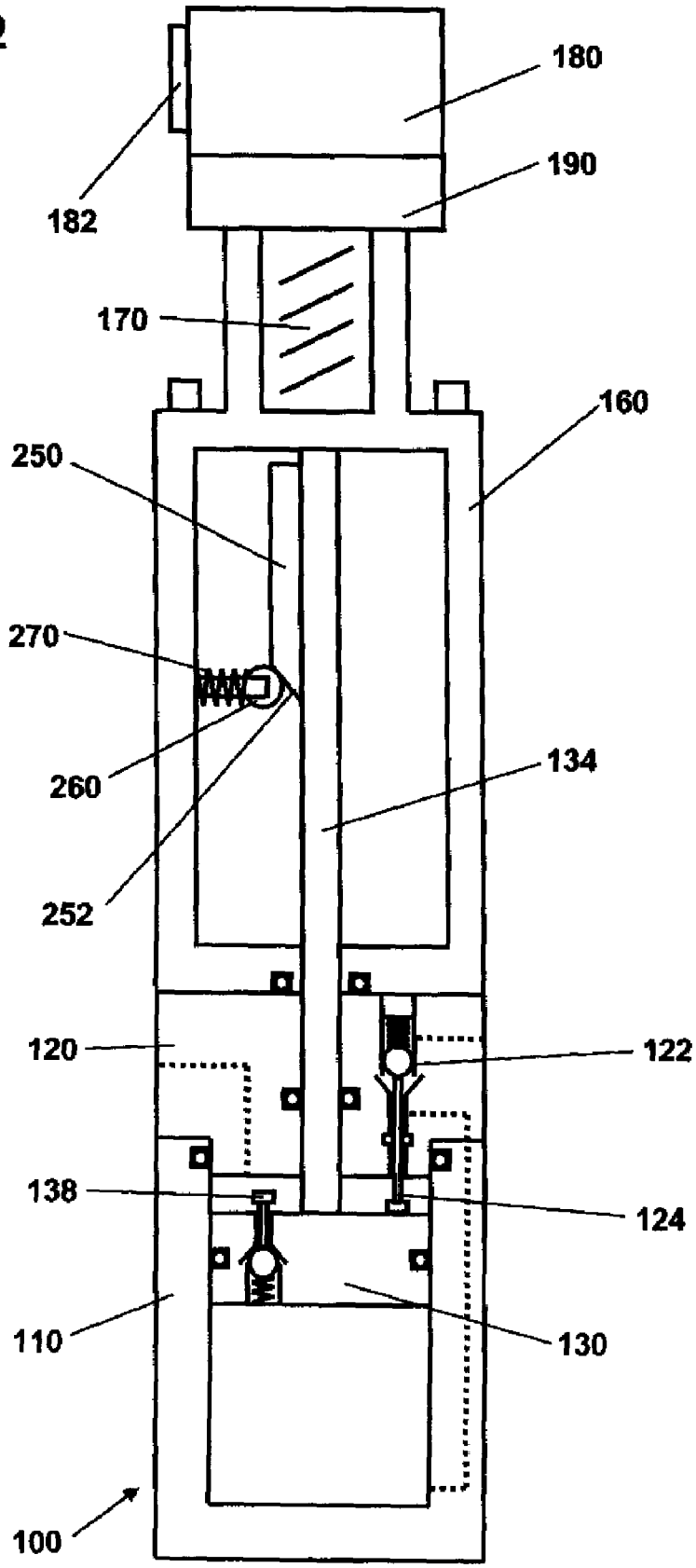

Referring to FIG. 5*b*, the cam member 250 is positioned axially on shaft 134 such that when piston 130 is in the armed position, cam follower 260 is just starting to engage tapered section 252 on cam member 250. In this position, cam follower 260 exerts and upward force on cam member 250, and thus on shaft 134, through the mechanical advantage provided by tapered section 252. In the event that the pressure acting below piston 130 is insufficient to raise the piston when the motor and/or latching mechanism is disengaged, the upward force from the cam follower 260 may assist in moving the piston 130 upward to the bleed-off position. Since the length C of tapered section 252 is greater than the difference between distance A and distance B, the cam follower will continue to exert an upward force on shaft 134 until plunger 138 is depressed.

Figure 6A:
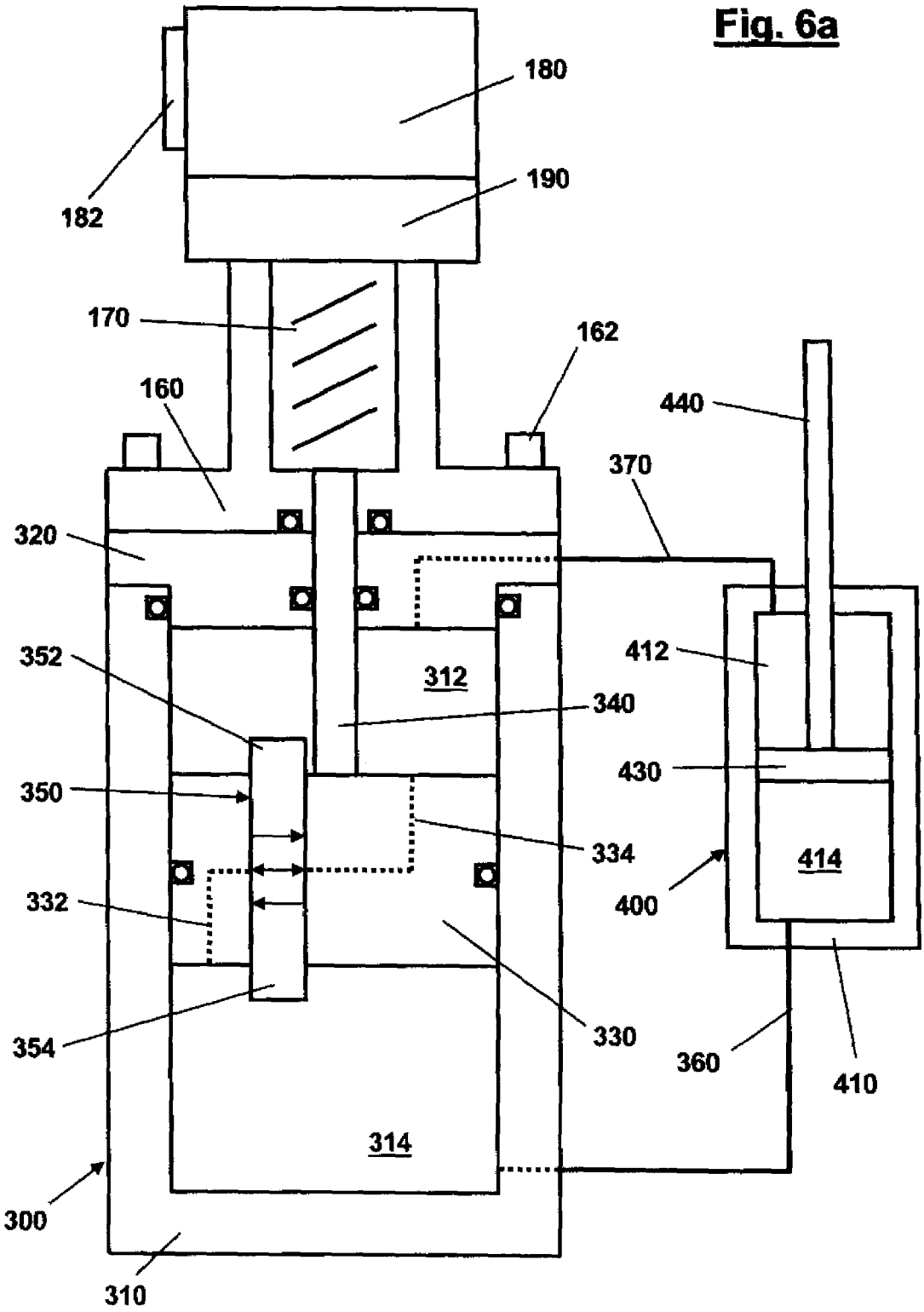
FIGS. 6*a* through 6*c* show schematic representations of an alternative exemplary embodiment subsea electric HPU which is double-acting.

Referring to FIG. 6*a*, an alternative exemplary embodiment the present invention includes a subsea electric-hydraulic power unit (electric HPU) 300 which can be used to power a double-acting hydraulic actuator 400. In this exemplary embodiment, the HPU 300 comprises a housing 310 and cap 320, which cooperate to define a piston chamber. Piston 330 is disposed within the piston chamber, and divides the piston chamber into an upper chamber 312 and a lower chamber 314. Stem 340 is attached to piston 330, and extends through an opening in cap 320. In other embodiments, housing 310 and cap 320 could be formed as one integral component, with an opening at the bottom of the housing, which could be sealed by a blind endcap member.

Electric motor 180 may be mounted to cap 320 via mounting flange 160 and bolts 162, or by any other suitable mounting means. The motor 180 may be connected to a motor controller and a power source via connector 182. The motor controller may be deployed subsea and may communicate with a surface rig or vessel via an electrical umbilical or by acoustic signals. Alternatively the motor could be controlled directly from the surface. The motor may be powered by a subsea deployed power source, such as batteries, or the motor could be powered directly from the surface.

In this exemplary embodiment, the motor 180 is connected to stem 340 via planetary gearbox 190 and roller screw assembly 170. Thus, when motor 180 is energized, the rotational motion of the motor is converted into axial motion of the stem 340, thereby also moving piston 330 axially within the piston chamber. Alternatively, either the gearbox 190 or roller screw assembly 170, or both, could be omitted or replaced by any other suitable transmission devices. Also alternatively, the motor 180 could comprise a linear motor.

Double-acting hydraulic actuator 400 comprises a housing 410, a piston 430, an upper actuator chamber 412 above piston 430, a lower actuator chamber 414 below piston 430, and an actuator shaft 440 attached to the piston in a manner well known in the art. The motion of actuator shaft 440 can be used to perform any suitable function. Hydraulic line 370 connects upper actuator chamber 412 to upper chamber 312 in HPU 300. Similarly, hydraulic line 360 connects lower actuator chamber 414 to lower chamber 314 in HPU 300. In this exemplary embodiment, HPU 300 and actuator 400 comprise an essentially closed hydraulic system.

Piston 330 further comprises a spool 350 slidably disposed within the piston. A flow passage 334 extends from one side of the spool 350 to upper chamber 312, and a flow passage 332 extends from the other side of the spool 350 to lower chamber 314. Spool 350 comprises an upper end 352, a lower end 354, and three transverse passages spaced axially along the length of the spool 350. Each transverse passage is arranged to connect flow passages 332 and 334 when the spool 350 is positioned appropriately in piston 330. When the spool 350 is in a central position, as shown in FIG. 6*a*, the central transverse passage is aligned with flow passages 332 and 334. The central transverse passage allows flow in either direction through spool 350. Thus, if piston 330 is moved up or down by motor 180, fluid may flow from upper chamber 312 to lower chamber 314, or vice-versa, through the piston 330 and spool 350. Thus, the piston 330 can be moved up or down without affecting the position of piston 430 in actuator 400. This may be considered a neutral mode of operation of the HPU 300. In other embodiments, the central transverse passage, and thus the neutral mode of operation, may be eliminated.

Figure 6B:
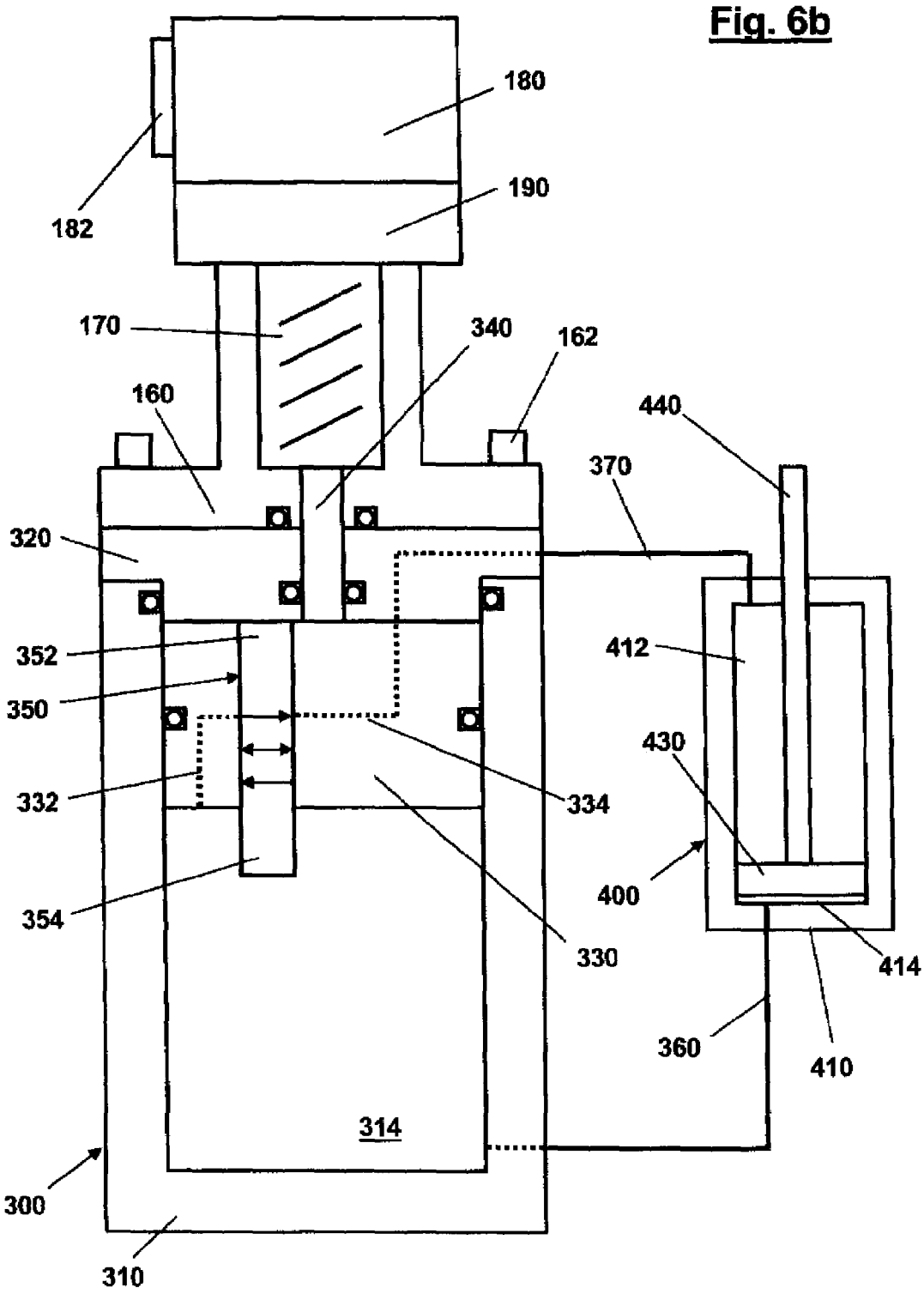

Referring to FIG. 6*b*, when it is desired to move piston 430 and shaft 440 downward, upper actuator chamber 412 may be pressurized by performing the following steps. First, the piston 330 is moved all the way up until the upper end 352 of spool 350 contacts cap 320. Spool 350 is pushed downward within piston 330 to a lower position, wherein the upper transverse passage is aligned with flow passages 332 and 334. The upper transverse passage comprises a check valve which only allows flow from left to right, as shown in FIG. 6*b*. Thus, when piston 330 is stroked downward, fluid is permitted to flow from lower chamber 314 to upper chamber 312 through piston 330 and spool 350. Through precise control of motor 180, the downward movement of piston 330 is stopped before the lower end 354 of spool 350 contacts housing 310. Thus the spool 350 is maintained in the lower position. When piston 330 is stroked upward, the check valve in the upper transverse passage prevents fluid flow from upper chamber 312 to lower chamber 314. Thus, the fluid from upper chamber 312 is forced through flow line 370 into upper actuator chamber 412. At the same time, fluid in lower actuator chamber 414 is forced through flow line 360 into lower chamber 314. Thus, actuator piston 430 and shaft 440 are moved downward. This can be considered the retraction mode of operation of the HPU 300.

Figure 6C:
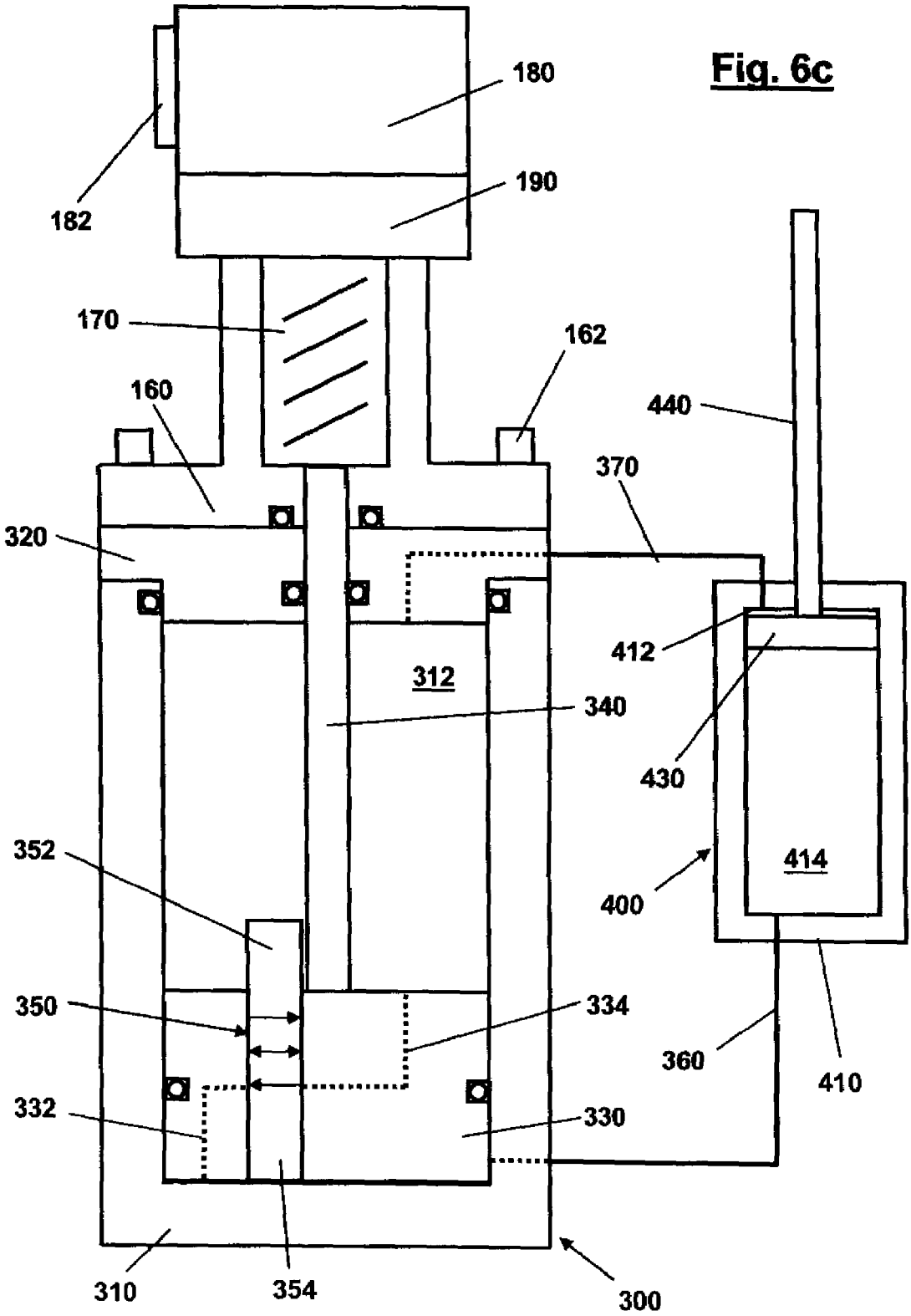

Referring to FIG. 6*c*, when it is desired to move piston 430 and shaft 440 upward, lower actuator chamber 414 may be pressurized by performing the following steps. First, the piston 330 is moved all the way down until the lower end 354 of spool 350 contacts housing 310. Spool 350 is pushed upward within piston 330 to an upper position, wherein the lower transverse passage is aligned with flow passages 332 and 334. The lower transverse passage comprises a check valve which only allows flow from right to left, as shown in FIG. 6*c*. Thus, when piston 330 is stroked upward, fluid is permitted to flow from upper chamber 312 to lower chamber 314 through piston 330 and spool 350. Through precise control of motor 180, the upward movement of piston 330 is stopped before the upper end 352 of spool 350 contacts cap 320. Thus the spool 350 is maintained in the upper position. When piston 330 is stroked downward, the check valve in the lower transverse passage prevents fluid flow from lower chamber 314 to upper chamber 312. Thus, the fluid from lower chamber 314 is forced through flow line 360 into lower actuator chamber 414. At the same time, fluid in upper actuator chamber 412 is forced through flow line 370 into upper chamber 312. Thus, actuator piston 430 and shaft 440 are moved upward. This can be considered the extension mode of operation of the HPU 300.

It should be noted that although the HPU 300 has at least two distinct modes of operation, the desired operational mode is selected by simply moving the piston 330 via precise control of the motor 180. Thus, no additional control signal is required to select the operational mode of the HPU. In some embodiments, actuator 400 may be large relative to HPU 300, such that a single stroke of piston 330 is insufficient to move piston 430 the desired distance. In this case, the above steps may be repeated until the desired position of piston 430 is achieved. In other embodiments, HPU 300 may be used to operate any reversible hydraulic component, such as rotary actuator or hydraulic motor.

The present invention is directed to an electric-hydraulic power unit. In one illustrative embodiment, the device comprises a body having a movable pressure barrier positioned therein, the movable pressure barrier defining first and second chambers therein, a configurable flow path in fluid communication with the first and second chambers, and at least one valve for configuring the flow path in a first state wherein fluid may flow within the flow path only in a direction from the first chamber toward the second chamber, and a second state wherein fluid within the flow path may flow in both directions between the first and second chambers.

In another illustrative embodiment, the device comprises a body having a movable pressure barrier positioned therein, the movable pressure barrier defining first and second chambers therein, a configurable flow path defined in the movable pressure barrier, the configurable flow path being in fluid communication with the first and second chambers, and at least one valve coupled to the movable pressure barrier for configuring the flow path in a first state wherein fluid may flow within the flow path only in a direction from the first chamber toward the second chamber, and a second state wherein fluid within the flow path may flow in both directions between the first and second chambers.

In yet another illustrative embodiment, the device comprises a body having a movable pressure barrier positioned therein, the movable pressure barrier defining first and second chambers therein, a configurable flow path defined in the movable pressure barrier, the configurable flow path being in fluid communication with the first and second chambers, and at least one check valve coupled to the movable pressure barrier and positioned in the flow path, the check valve adapted to configure the flow path in a first state wherein fluid may flow within the flow path only in a direction from the first chamber toward the second chamber, and a second state wherein fluid within the flow path may flow in both directions between the first and second chambers.

In still another illustrative embodiment, the device comprises a body having a movable pressure barrier positioned therein, the movable pressure barrier defining at least one chamber therein, and an electric motor operatively coupled to the movable pressure barrier, the electric motor adapted to, when energized, create a resistance force to a pressure force created by a pressure existing in the chamber, and, when de-energized, allow the pressure barrier in the chamber to move in response to the pressure force to a position within the body wherein the pressure within the chamber may be released from the chamber.

In a further illustrative embodiment, the device comprises a body having a movable pressure barrier positioned therein, the movable pressure barrier defining at least one chamber therein, and an electric latch adapted to, when energized, prevent the movable pressure barrier from moving within the body in response to a pressure force created by a pressure existing in the chamber, and, when de-energized, allow the movable pressure barrier in the chamber to move in response to the pressure force to a position within the body wherein the pressure within the chamber may be released.

In yet a further illustrative embodiment, the device comprises a body having a movable pressure barrier positioned within the body, the pressure barrier defining at least one chamber within the body, and an electric motor operatively coupled to the movable pressure barrier, the motor adapted to create a desired working outlet pressure for the device by causing movement of the pressure barrier within the body, move the pressure barrier to a first position to thereby allow the working pressure to exist within the chamber and, when the motor is energized, create a resistance force to a pressure force created by the working pressure existing in the chamber, and, when the motor is de-energized, allow the pressure barrier to move in response to the pressure force to a second position where the working pressure within the chamber may be released from the chamber.

In still a further illustrative embodiment, the device comprises a first body, a first movable pressure barrier positioned within the first body, the first movable pressure barrier defining a first chamber and a second chamber within the first body, a second body, a second movable pressure barrier positioned within the second body, the second movable pressure barrier defining a third chamber and a fourth chamber within the second body, wherein the first chamber is in fluid communication with the third chamber and the second chamber is in fluid communication with the fourth chamber, an output shaft coupled to the second movable pressure barrier, and a controllable valve that is adapted to configure a flow path between the first and second chambers.

In another illustrative embodiment, the device comprises a body having a movable pressure barrier positioned therein, the movable pressure barrier defining first and second chambers therein, a configurable flow path in fluid communication with the first and second chambers, and means for configuring the flow path in a first state wherein fluid may flow within the flow path only in a direction from the first chamber toward the second chamber, and a second state wherein fluid within the flow path may flow in both directions between the first and second chambers.

In yet another illustrative embodiment, the device comprises a body having a movable pressure barrier positioned therein, the movable pressure barrier defining at least one chamber therein, and an electrically powered resistance means operatively coupled to the movable pressure barrier, the resistance means adapted to, when energized, create a resistance force to a pressure force created by a pressure existing in the chamber, and, when de-energized, allow the pressure barrier in the chamber to move in response to the pressure force to a position within the body wherein the pressure within the chamber may be released from the chamber.

In still another illustrative embodiment, the device comprises a body and a movable pressure barrier positioned in the body, wherein the movable pressure barrier defines at least one chamber within the body, the device being configurable in at least two operational modes, each of the operational modes being selectable by movement of the pressure barrier through a switching series of positions.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A device, comprising:

a body having a movable pressure barrier positioned therein, said movable pressure barrier defining at least one chamber therein; and an electric latch adapted to:

when energized, prevent said movable pressure barrier from moving within said body in response to a pressure force created by a pressure existing in said chamber; and, when de-energized, allow said movable pressure barrier in said chamber to move in response to said pressure force to a position within said body wherein said pressure within said chamber may be released.

2. The device of claim 1, wherein said movable pressure barrier has a structural member operatively coupled thereto, and said electric latch is adapted to, when energized, engage at least a portion of said structural member.

3. The device of claim 1, wherein said movable pressure barrier is a piston and said structural member is a rod operatively coupled to said piston.

4. The device of claim 1, further comprising an electric motor operatively coupled to said movable pressure barrier, said electric motor adapted to move said movable pressure barrier within said body.

5. The device of claim 1, further comprising a hydraulically actuable device in fluid communication with said chamber, wherein said device is adapted to be actuated by said pressure existing in said chamber, and said latch, in said energized state, is adapted to prevent movement of said pressure barrier to thereby maintain said pressure within said chamber.

6. The device of claim 1, further comprising a SCSSV in fluid communication with said chamber, wherein said SCSSV is adapted to be maintained in an open position by said pressure existing in said chamber, and said latch, in said energized state, is adapted to prevent movement of said pressure barrier to thereby maintain said pressure within said chamber.

7. The device of claim 1, further comprising at least one valve, said at least on valve being actuatable to establish a flow path for releasing said pressure from said chamber, said valve being actuated when said electric latch, in said de-energized state, allows said pressure barrier to move to said position within said body.

8. The device of claim 1, further comprising at least one valve coupled to said pressure barrier, said at least one valve actuatable to establish a flow path for releasing said pressure from said chamber, said valve being actuated when said electric latch, in said de-energized state, allows said pressure barrier to move to said position within said body.

9. The device of claim 1, further comprising at least one valve coupled to said movable pressure barrier, said at least one valve actatable to establish a flow path for releasing said pressure in said chamber, said at least one valve being actuated when said electric latch, in said de-energized state, allows said pressure barrier to move to said position where said at least one valve engages at least one surface of said body.

10. The device of claim 1, wherein said movable pressure barrier is a piston.

11. The device of claim 1, further comprising a camming device operatively coupled to said moveable pressure barrier wherein said movable pressure barrier may be positioned at a location such that said camming device exerts a force that tends to move said pressure barrier within said body.

12. The apparatus of claim 11 wherein said device further comprises a structural member operatively coupled to said movable pressure barrier, said structural member extending through a housing and said camming device is operatively coupled between said structural member and said housing.

13. A device, comprising:

a body having a movable pressure barrier positioned therein, said movable pressure barrier defining at least one chamber therein; and an electrically powered resistance means operatively coupled to said movable pressure barrier, said resistance means adapted to:

when energized, create a resistance force to a pressure force created by a pressure existing in said chamber; and, when de-energized, allow said pressure barrier in said chamber to move in response to said pressure force to a position within said body wherein said pressure within said chamber may be released from said chamber.

14. The device of claim 13, wherein said resistance means comprises an electric motor.

15. The device of claim 13, wherein said resistance means comprises an electric latch.

* * * * *